US008366078B2

(12) United States Patent
Meglino

(10) Patent No.: US 8,366,078 B2
(45) Date of Patent: Feb. 5, 2013

(54) PRIVACY FENCE INSERTS WITH LOCKING MEMBER

(75) Inventors: Don A. Meglino, Sea Cliff, NY (US); Christine Meglino, legal representative, Sea Cliff, NY (US)

(73) Assignee: Pexco LLC, Alpharetta, GA (US)

( * ) Notice: Subject to any disclaimer, the term of this patent is extended or adjusted under 35 U.S.C. 154(b) by 191 days.

(21) Appl. No.: 12/802,747

(22) Filed: Jun. 11, 2010

(65) Prior Publication Data

US 2011/0017966 A1 Jan. 27, 2011

Related U.S. Application Data

(60) Provisional application No. 61/268,525, filed on Jun. 11, 2009.

(51) Int. Cl.
*B21F 27/00* (2006.01)

(52) U.S. Cl. ..... 256/34; 256/22; 256/24; 256/32

(58) Field of Classification Search ..... 256/19, 256/21, 22, 24, 31, 32, 34, 65.14
See application file for complete search history.

(56) References Cited

U.S. PATENT DOCUMENTS

| | | | | |
|---|---|---|---|---|
| 3,452,501 | A | 7/1969 | Zimmer et al. | |
| 3,712,590 | A | 1/1973 | Tochner et al. | |
| 4,085,954 | A | 4/1978 | Thompson | |
| 4,508,319 | A * | 4/1985 | Tappan et al. | 256/19 |
| 4,512,556 | A | 4/1985 | Meglino | |
| 4,570,906 | A | 2/1986 | Walden | |
| 4,723,761 | A | 2/1988 | Cluff | |
| 4,725,044 | A | 2/1988 | Cluff | |
| 4,860,998 | A | 8/1989 | Snyder | |
| 4,995,591 | A | 2/1991 | Humphrey et al. | |
| 5,056,761 | A | 10/1991 | Meglino | |
| 5,106,058 | A | 4/1992 | Finkelstein | |
| 5,165,664 | A | 11/1992 | Cluff | |
| 5,184,801 | A | 2/1993 | Finkelstein | |
| 5,234,199 | A | 8/1993 | Cluff | |
| 5,275,381 | A | 1/1994 | Cluff | |
| RE35,208 | E | 4/1996 | Finkelstein | |
| 5,551,205 | A * | 9/1996 | Kidder | 52/800.13 |
| 5,584,468 | A | 12/1996 | Meglino | |
| 5,651,533 | A * | 7/1997 | Ling | 256/34 |
| 5,687,957 | A | 11/1997 | Finkelstein | |
| 5,775,676 | A | 7/1998 | Hoggan | |
| 5,794,922 | A | 8/1998 | Meglino | |
| 5,799,929 | A | 9/1998 | Meglino | |
| 5,806,839 | A | 9/1998 | Meglino | |
| RE36,085 | E | 2/1999 | McLaughlan | |
| 5,899,442 | A | 5/1999 | Meglino | |
| 6,068,243 | A * | 5/2000 | Hoggan | 256/34 |
| 6,164,628 | A | 12/2000 | Hoggan | |
| 6,182,947 | B1 | 2/2001 | Meglino | |
| 6,402,127 | B1 | 6/2002 | Meglino | |
| 7,207,551 | B2 | 4/2007 | Fielden | |
| 7,878,487 | B2 * | 2/2011 | Pearson | 256/34 |

* cited by examiner

*Primary Examiner* — Victor Macarthur
*Assistant Examiner* — Jonathan Masinick
(74) *Attorney, Agent, or Firm* — Jacobson Holman PLLC

(57) ABSTRACT

Privacy systems for a fence include a plurality of elongated privacy inserts positioned in at least one locking member having a plurality of locking tabs. The locking member is laterally inserted into the bottom of a chain link fence perpendicular to the privacy inserts. Apertures near the bottom edges of the front and rear sides of the privacy inserts engage the locking tabs thereby retaining the privacy inserts in alignment in the chain link fence. The locking tabs on front and rear support walls of the locking member are preferably laterally offset from each other.

12 Claims, 17 Drawing Sheets

PRIVACY FENCE INSERTS WITH LOCKING MEMBER

RELATED APPLICATION DATA

This application claims the benefit of U.S. provisional patent application 61/268,525 filed on Jun. 11, 2009.

The present invention is directed to a privacy system for chain link fences and, more particularly, to a privacy system comprising inserts and a locking member for locking and retaining the privacy inserts in the chain link fence.

BACKGROUND

Chain link fences have been widely used for many years to satisfy fencing requirements. While they provide acceptable strength and durability over many years, they do not provide privacy or serve as a windbreak due to their apertured construction. Various inserts, typically referred to as "slats" or "privacy inserts," have been used for increasing the privacy of a chain link fence, as well as serving as a windbreak. Retaining members may be provided to maintain the privacy inserts in the chain link fence and to maintain alignment of the inserts. Such retaining members may include a separate bottom member which attaches to the bottom of the privacy inserts.

SUMMARY OF THE INVENTION

Embodiments of the present invention are directed to privacy fence inserts wherein a plurality of elongated privacy inserts are positioned, usually vertically, within the woven wires of a chain link fence and a locking member comprising retaining means such as a plurality of locking tabs. In one preferred illustrated embodiment, the locking member is laterally inserted into the bottom of a chain link fence perpendicular to the privacy inserts. Apertures near the bottom edges of the front and rear sides of the privacy inserts engage the locking tabs thereby retaining the privacy inserts in alignment in the chain link fence.

One embodiment of the present invention comprises a plurality of elongated, tubular privacy inserts wherein the front and rear sides of each privacy insert has a horizontally extending aperture or slot spaced from the bottom edge of the privacy insert. A substantially U-shaped locking member is also provided comprising a front and rear wall and a plurality of short inwardly protruding locking tabs extending from the interior surfaces of the front and rear side walls of the locking member. The plurality of locking tabs preferably extend the width of the locking member. In this embodiment, the locking tabs extending inwardly from the interior surface of the front wall of the locking member are offset from the locking tabs extending from the interior surface of the rear wall. The locking tabs engage the apertures in the privacy inserts.

A second embodiment of the present invention comprises a plurality of privacy inserts and a locking member generally configured in the same manner as the first embodiment, however, the locking tabs extending from the front wall are aligned with the locking tabs extending from the rear wall. In addition, the shape of the locking tabs is different from the locking tabs shown in the first embodiment. A bottom side of the locking member optionally further comprises a plurality of apertures, e.g. evenly-spaced along the bottom of the locking member.

A third embodiment of the present invention comprises a plurality of privacy inserts and at least one locking member generally configured in the same manner as the second embodiment, however, the locking tabs extending inwardly from the interior surface of the front wall of the locking member are offset from the locking tabs extending inwardly from the interior surface of the rear wall. Specifically, the plurality of locking tabs on the interior surface of the front wall are at least somewhat offset from the locking tabs extending from the interior surface of the rear wall. If the slots and locking tabs are properly dimensioned as described in one example below, the offset arrangement of the locking tabs ensures that at least one locking tab from both the front and one locking tab from the rear wall engage respective front and rear notches of an insert. In a preferred embodiment, a plurality of locking tabs from either or both the front wall and/or rear wall will engage the front and rear notches of an insert. For example, the front slot can be engaged by two locking tabs while the rear slot is engaged by a single locking tab. Alternatively, both the front and rear notches are engaged by a plurality of locking tabs.

A fourth embodiment of the present invention comprises a plurality of privacy inserts generally configured in the same manner as the first, second, and third embodiments, however, the retaining means comprises a plurality of evenly spaced tabs on the front and rear walls of the locking member. The front and rear tabs are preferably formed by punching portions of the front wall and rear wall of the locking member. Portions of the front and rear walls are cut along a lower slit and two side slits. The tabs are then pushed inwardly to create a plurality of downwardly extending tabs which are integrally connected to the corresponding wall at the top of the tab, leaving openings in the supporting wall. In one embodiment, the tabs on the front wall are positioned opposite the tabs on the rear wall. In an alternate embodiment, the tabs on the front wall of the bottom locking member are at least partially offset from the tabs on the rear wall as discussed in relation to the first and third embodiments described above.

DETAILED DESCRIPTION

The various embodiments of the present invention are directed to improved privacy systems comprising inserts and at least one locking member for fences, e.g. chain link fences.

One embodiment of the present invention is illustrated in FIGS. 1-5. In particular, the illustrated privacy system shows a plurality of vertically extending privacy inserts 10 with the bottom edges of the privacy inserts 10 inserted into a channel shaped locking member 20 which retains the privacy insert. In the illustrated embodiments, the locking member is positioned at the bottom of the privacy inserts and fence but the locking member can be less preferably positioned at the top or on a side (either vertically or on an angle) relative to the privacy inserts. Therefore, while the use of the words "top", "bottom", "height" and "width" are used herein, these terms relate to the various embodiments as they are shown in the Figures, but are not intended to be limiting to the orientation of the various components when installed in a fence.

Figure 1:
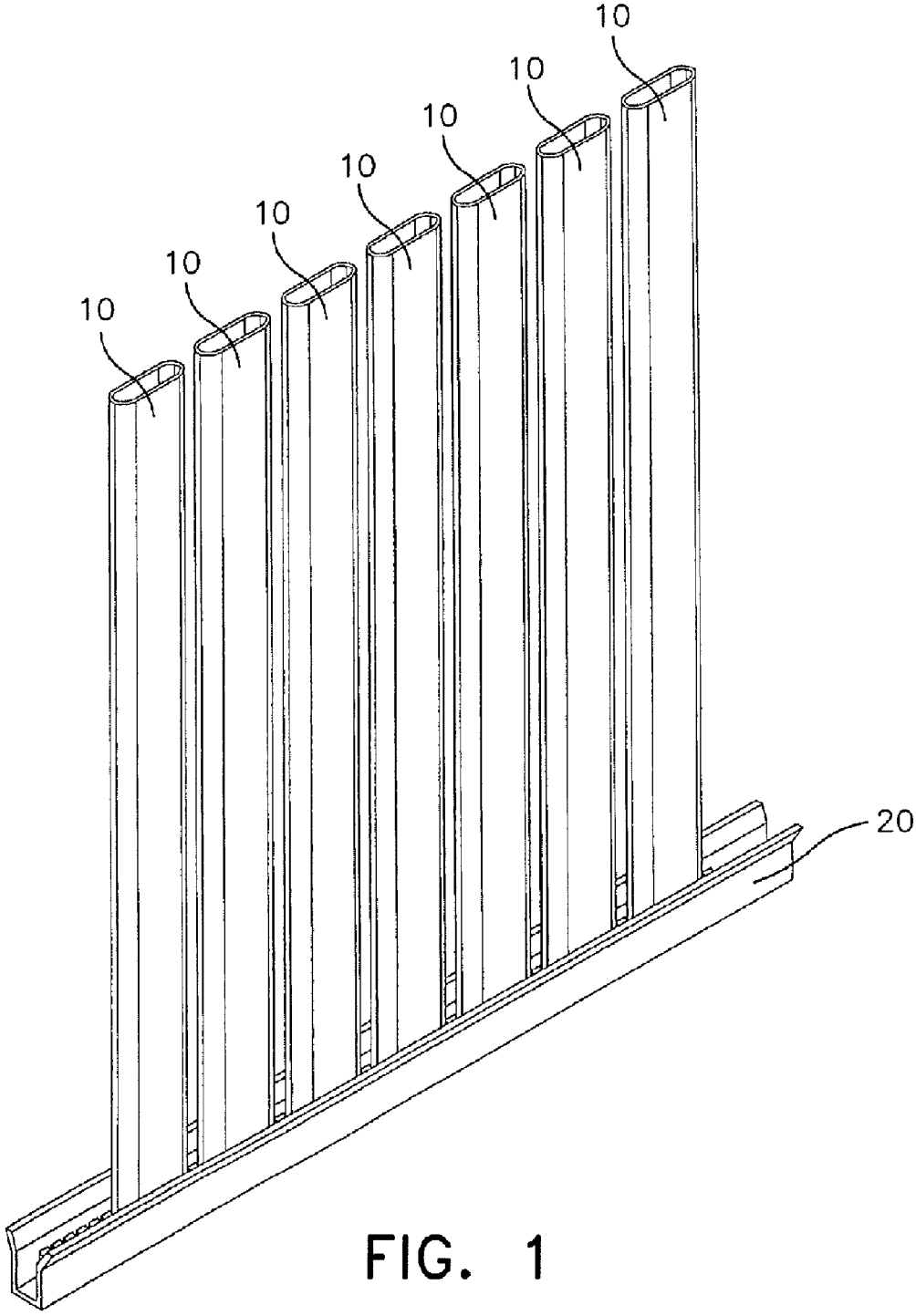
FIG. 1 is a partial perspective view of one embodiment of the present invention showing a plurality of privacy inserts positioned in a locking member.
Figure 2:
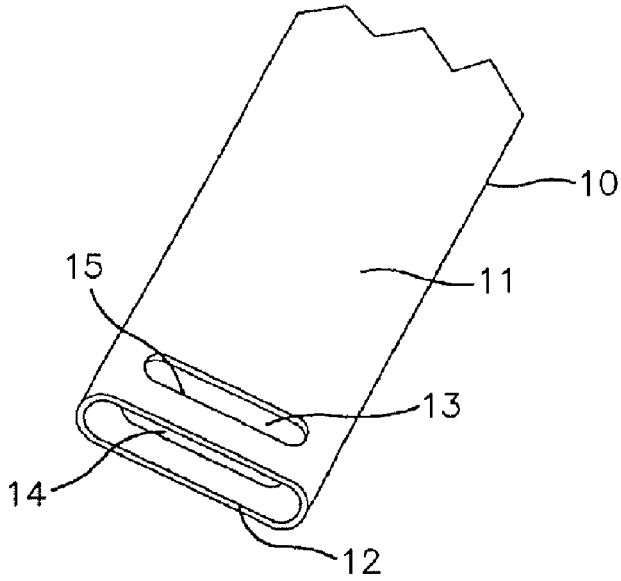
FIG. 2 is a partial perspective view of a privacy insert of one embodiment of the present invention.
Figure 3:
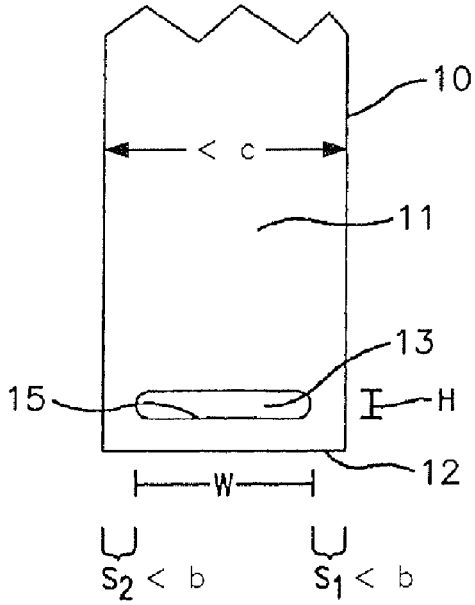
FIG. 3 is a partial front view of a privacy insert of FIG. 2.

As shown in FIGS. 2 and 3, illustrated privacy insert 10 comprises an elongated, hollow, substantially tubular body with an oblong cross-section having a front flat side 11, a rear flat side and a bottom edge 12. Front side 11 comprises a horizontally extending notch or aperture 13. As used herein, the term "notch" is used to include an aperture which extends entirely through a structure as well as an indentation which does not pass all the way through a structure. The privacy insert 10 comprises a notch having a width W and a height H. The distance a from the left side of one locking tab to the right side of an adjacent locking tab is preferably less than W. See FIG. 4.

The distance between the edge of the right side of aperture 13 and the right side of privacy insert 10 is referred to herein as S1, and the distance between the edge of the left side of aperture 13 and the left side of privacy 11 is referred to herein as S2. According to one embodiment, S1 and S2 are less than the size of a space b between two locking tabs. According to one embodiment, the width of the entire privacy insert is less than the cumulative width c of three locking tabs and three spaces between the locking tabs. As an example, aperture 13 can be approximately 1 1/16 inch wide and approximately 1 1/8 inch high. The rear side of illustrated privacy insert 10 is a mirror image of the front side 11 and comprises an identically sized aperture 14. As an example, the bottom edge 15 of the front aperture 13 is about 3/16 inch to about 1/4 inch from the bottom edge 12 of privacy insert 10. The flattened tubular shape of the privacy insert 10 of this embodiment is illustrated in FIG. 2. In this embodiment, each privacy insert is approximately 1/8 inch wide and approximately 5/16 inch deep. Apertures 13, 14 on the privacy inserts 10 are positioned to engage the locking tabs on the locking member when the inserts 10 are inserted into the locking member. In this position, there is minimal clearance between the bottom of the locking tab and the bottom edge of the aperture. Also the total width of a privacy insert is preferably less than the total distance spanned by three contiguous locking tabs and three spaces on one of said supports.

Figure 4:
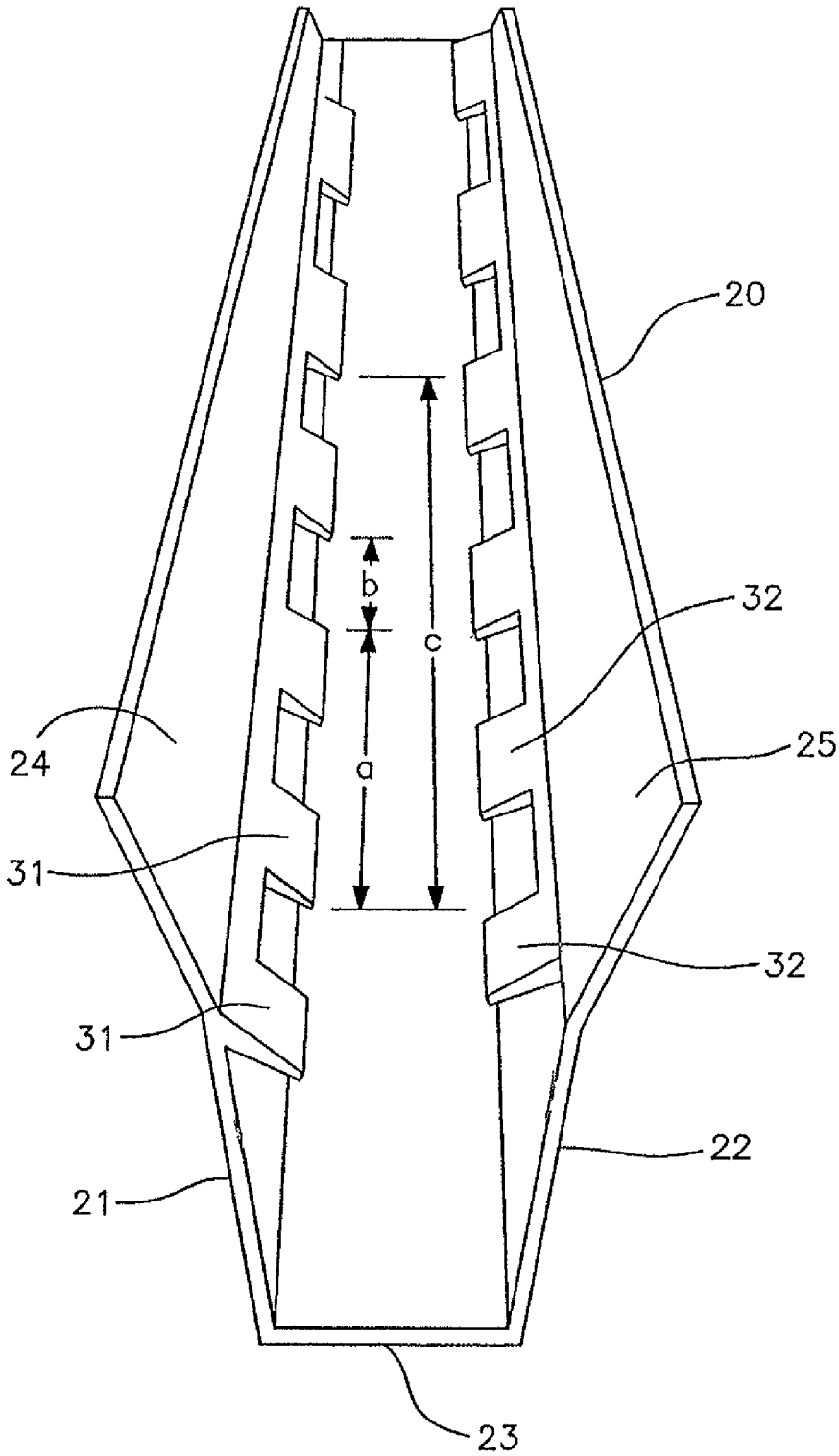
FIG. 4 is a front perspective view of the locking member of FIG. 1 of the present invention.
Figure 5:
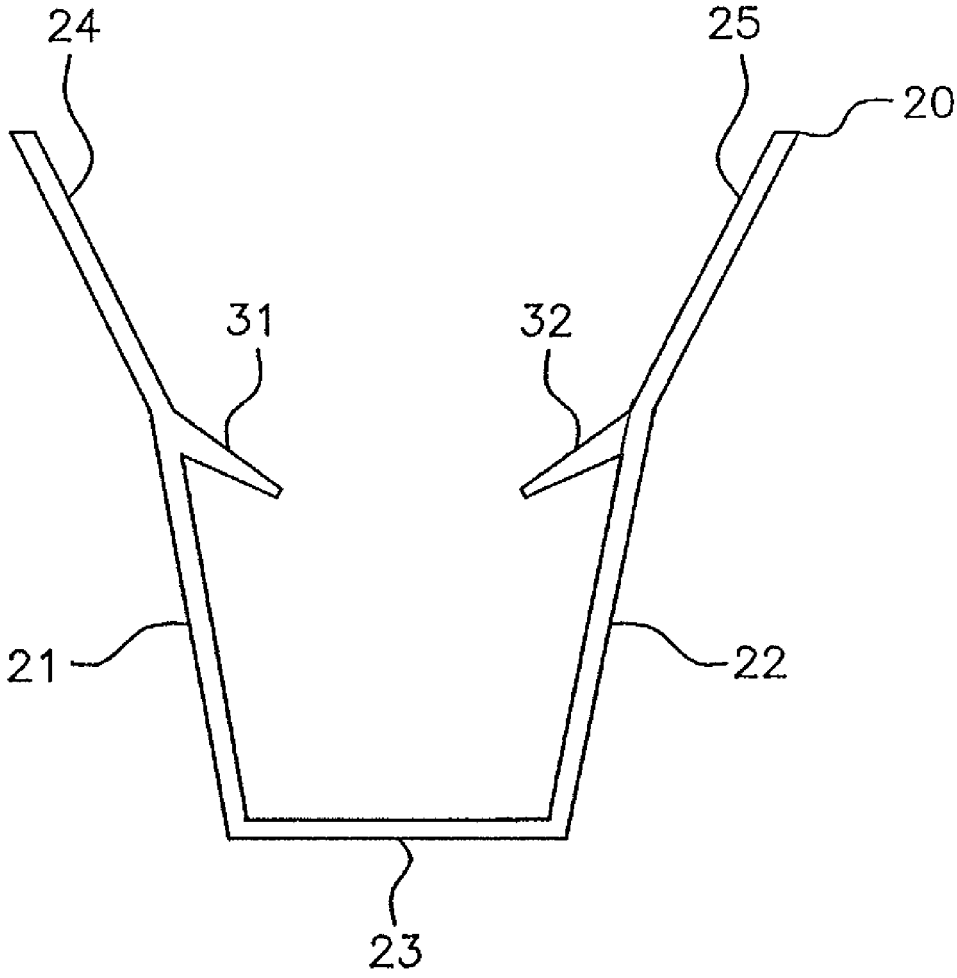
FIG. 5 is a side view of the locking member of FIG. 4.

With reference to FIGS. 4 and 5, locking member 20 is preferably a U-shaped channel having a front wall 21, a rear wall 22 and a bottom wall 23. The front and rear wall referred to herein are also referred to herein as supports since they support the locking tabs. The upper portion 24 of front wall 21 and the upper portion 25 of rear wall 22 are slightly splayed. This configuration provides a wider target area for an installer who is inserting privacy inserts 10 into locking member 20. The interior surfaces of front and rear walls 21 and 22 preferably comprise a plurality of protrusions or locking tabs 31 and 32 respectively, which extend along the entire width of the locking member 20. Front locking tabs 31 engage the front aperture of privacy insert 10 and rear locking tabs 32 engage the rear aperture 14. As illustrated in FIGS. 4 and 5, locking tabs 31 extend inwardly from the interior surface of front wall 21 and locking tabs 32 extend inwardly from the interior surface of rear wall 22. A first upper surface of the illustrated locking tabs is generally facing downwardly toward the connector and a second lower surface is generally facing upwardly away from said connector. This facilitates insertion of a privacy insert into said locking member and impedes removal of privacy insert. As illustrated in FIG. 4, locking tabs 31 are laterally offset from locking tabs 32. The locking tabs 31 and 32 are angled downwardly.

Figure 6:
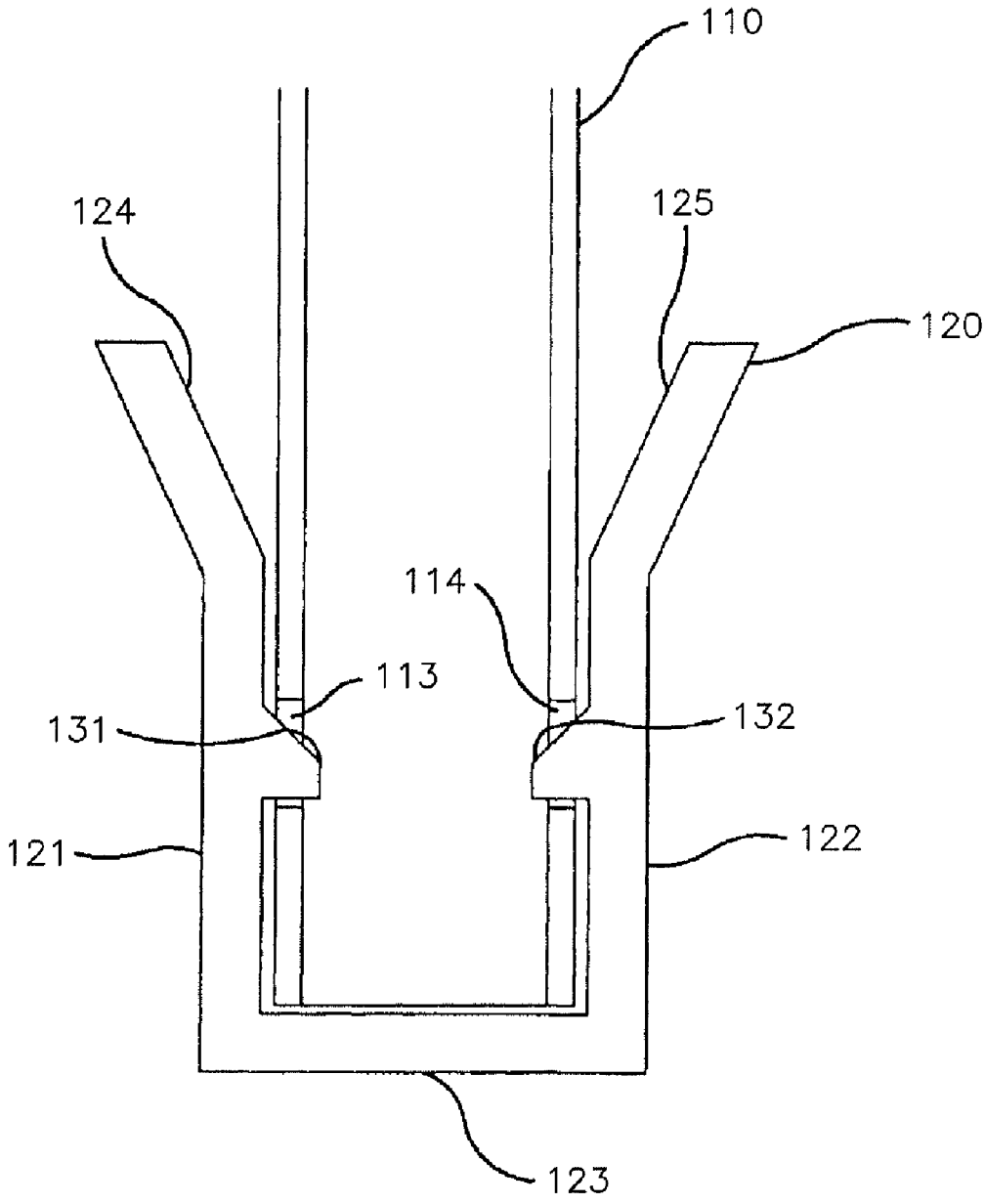
FIG. 6 is a partial, cross-sectional view of a privacy insert and a locking member of a second embodiment of the present invention.

A second embodiment of the present invention is illustrated in FIGS. 6-18. FIG. 6 is a partial cross-sectional view of a privacy insert 110 positioned in a locking member 120. The privacy insert 110 has a front aperture 113 and a rear aperture 114. Similar to the locking member of the first embodiment, the locking member 120 has a front wall 121, a rear wall 122 and a bottom wall 123 which connects the front and rear walls. Upper portion 124 of front wall 121 and upper portion 125 of rear wall 122 are in a slightly splayed configuration. In this configuration, when the privacy insert 110 is inserted into the bottom locking member 120, the front and rear locking tabs 131, 132, respectively, extend at least partially into the aperture. In this embodiment, an aperture receives the same number of front and rear locking tabs. Each locking tab is approximately 3/16 inch wide and the spacing between locking tabs is about 3/8 inch center to center.

Figure 7:
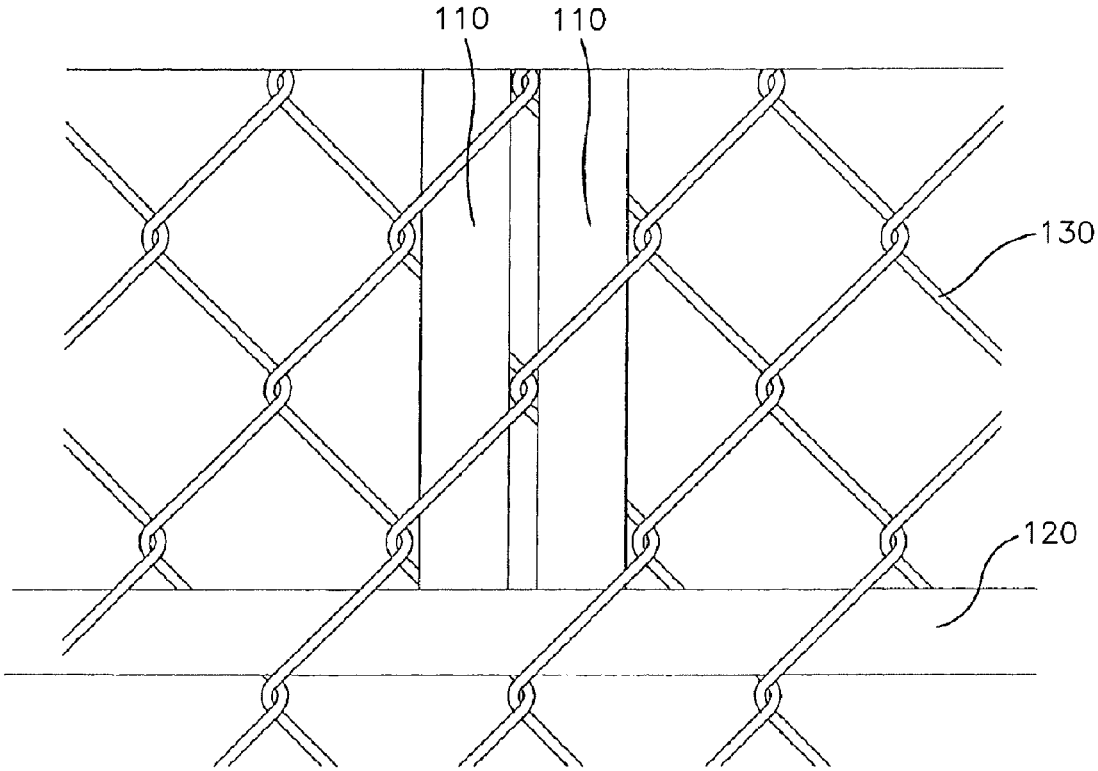
FIG. 7 is a partial, front view of the second embodiment of the privacy inserts and locking member of the present invention shown in a portion of a chain link fence.
Figure 8:
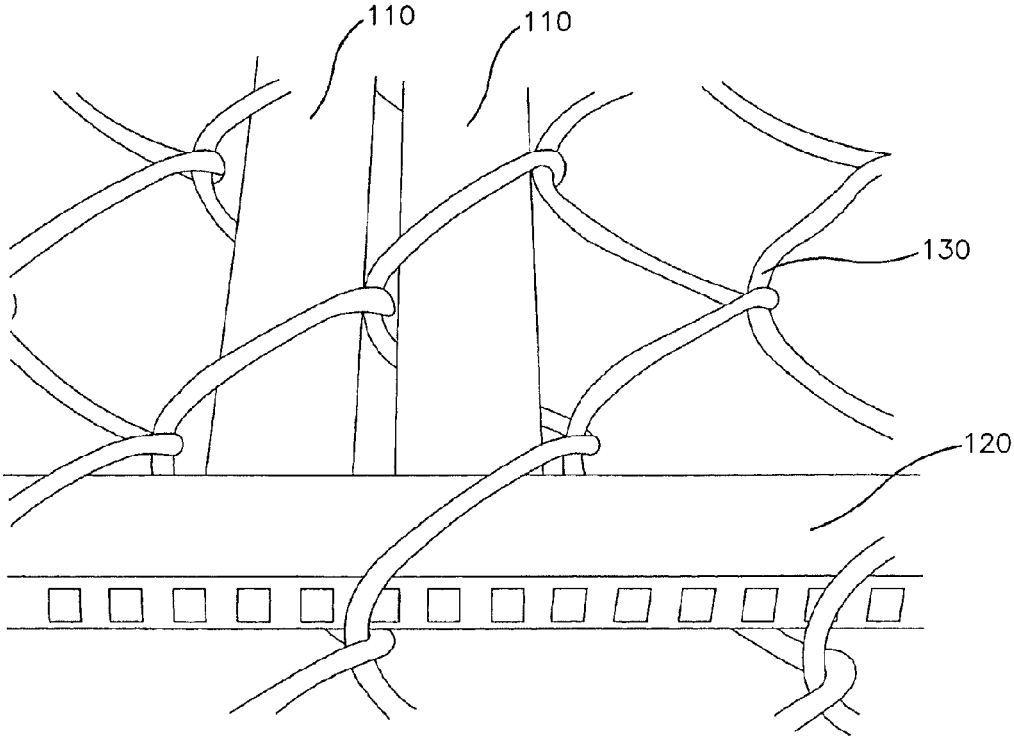
FIG. 8 is a partial, bottom, front perspective view of the embodiment shown in FIG. 7.
Figure 9:
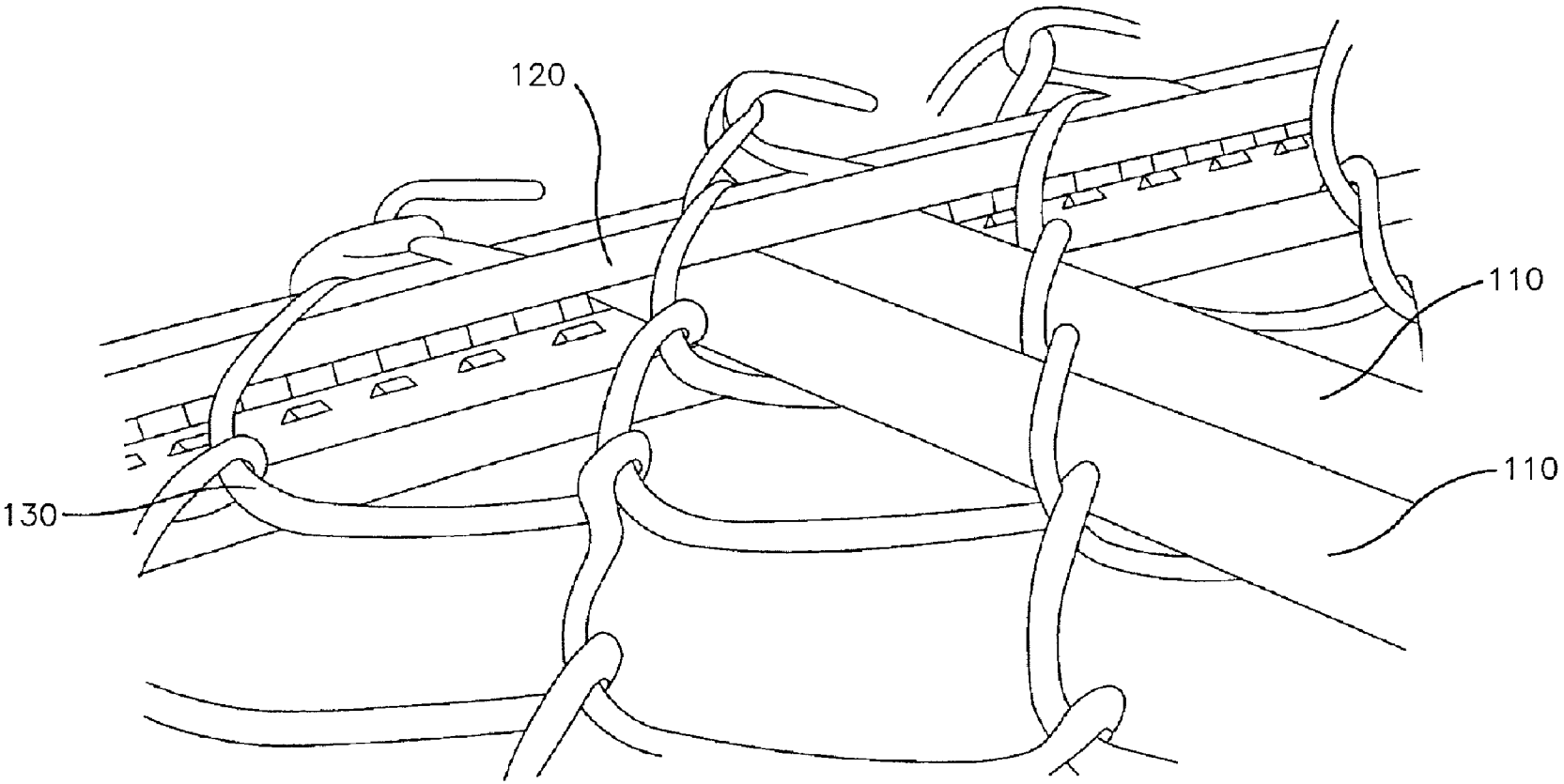
FIG. 9 is an upper perspective view of the embodiment shown in FIG. 7.

The illustrated partial fence assembly of FIGS. 7-9 shows two vertically extending privacy inserts 110 inserted in adjacent channels of a chain link fence with the bottom edges of privacy inserts 110 inserted into a channel-shaped locking member 120 which retains the privacy inserts and which inhibits the privacy inserts from moving either up or down. With reference to the orientation of the illustrated fence, locking member 120 sits laterally on the bottom of a fence 130. As can be seen in FIG. 9, bottom locking member 120 is inserted horizontally into a bottom channel of the fence. While FIGS. 7-9 only illustrate two privacy inserts 110 held in place by the locking member 120, privacy inserts would typically be positioned in an entire fence section.

Figure 10:
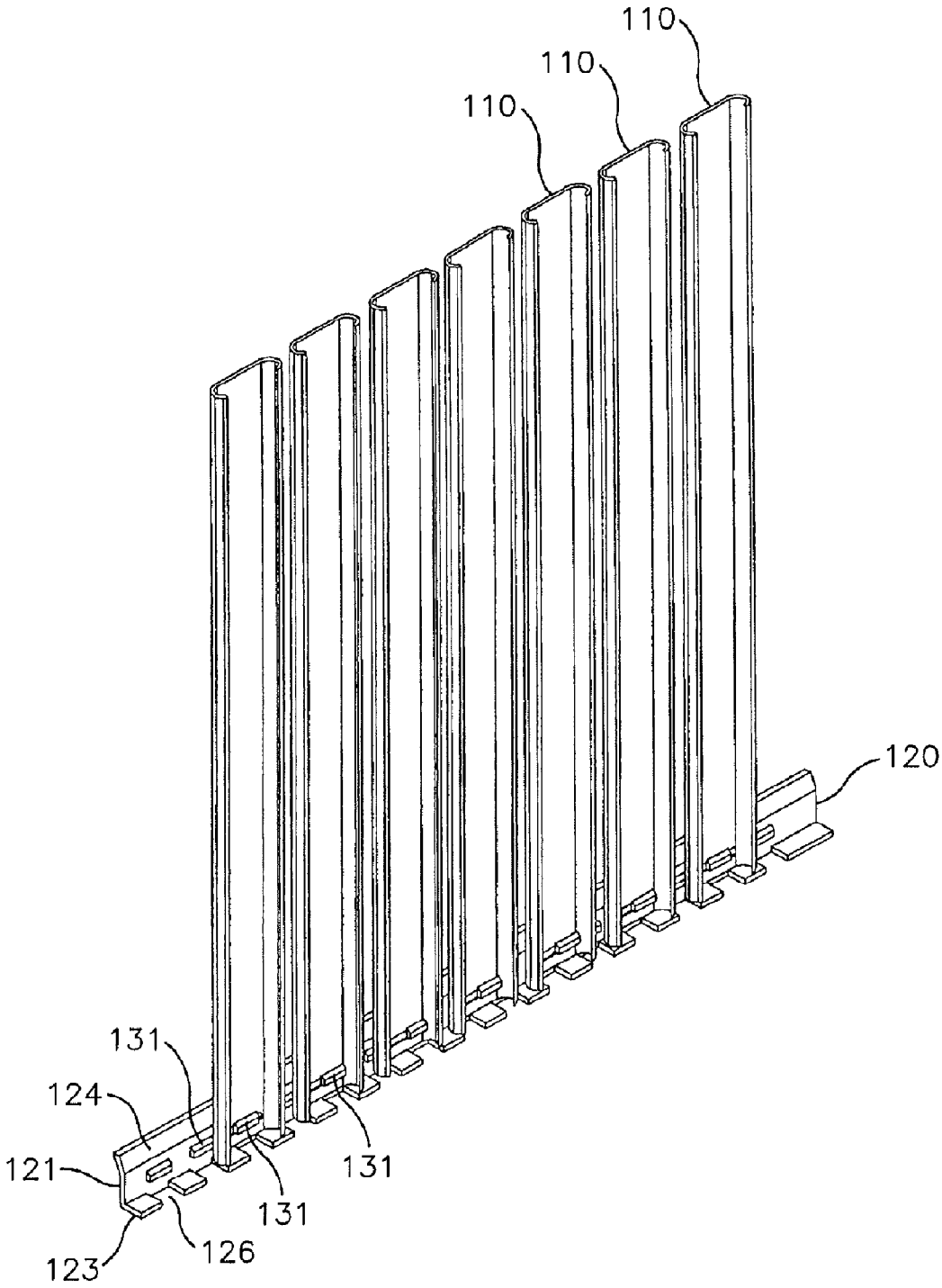
FIG. 10 is a partial, cross-sectional view of the privacy inserts and locking member of the second embodiment.
Figure 11:
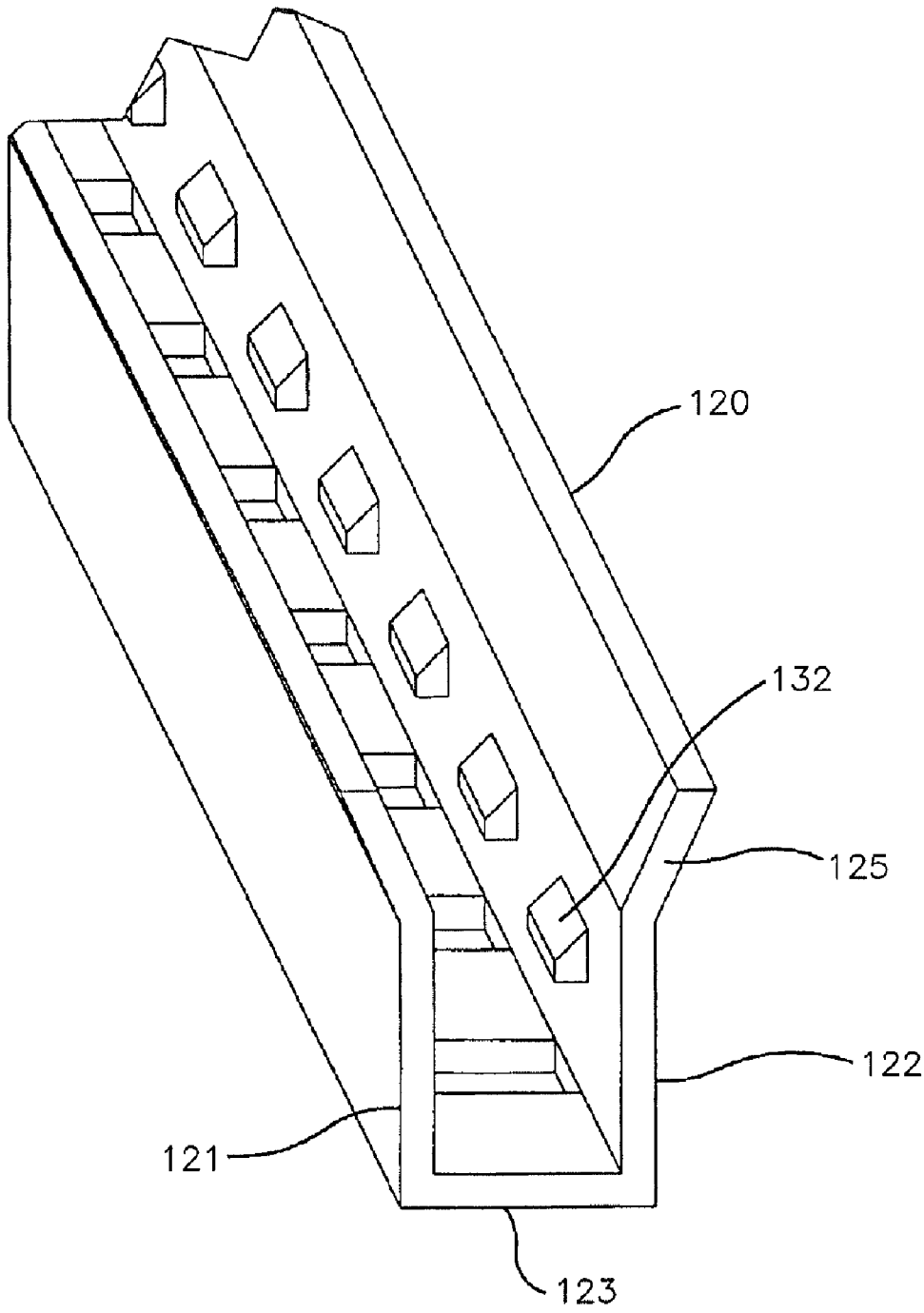
FIG. 11 is a front, side perspective view of the embodiment of the locking member shown in FIG. 6.
Figure 12:
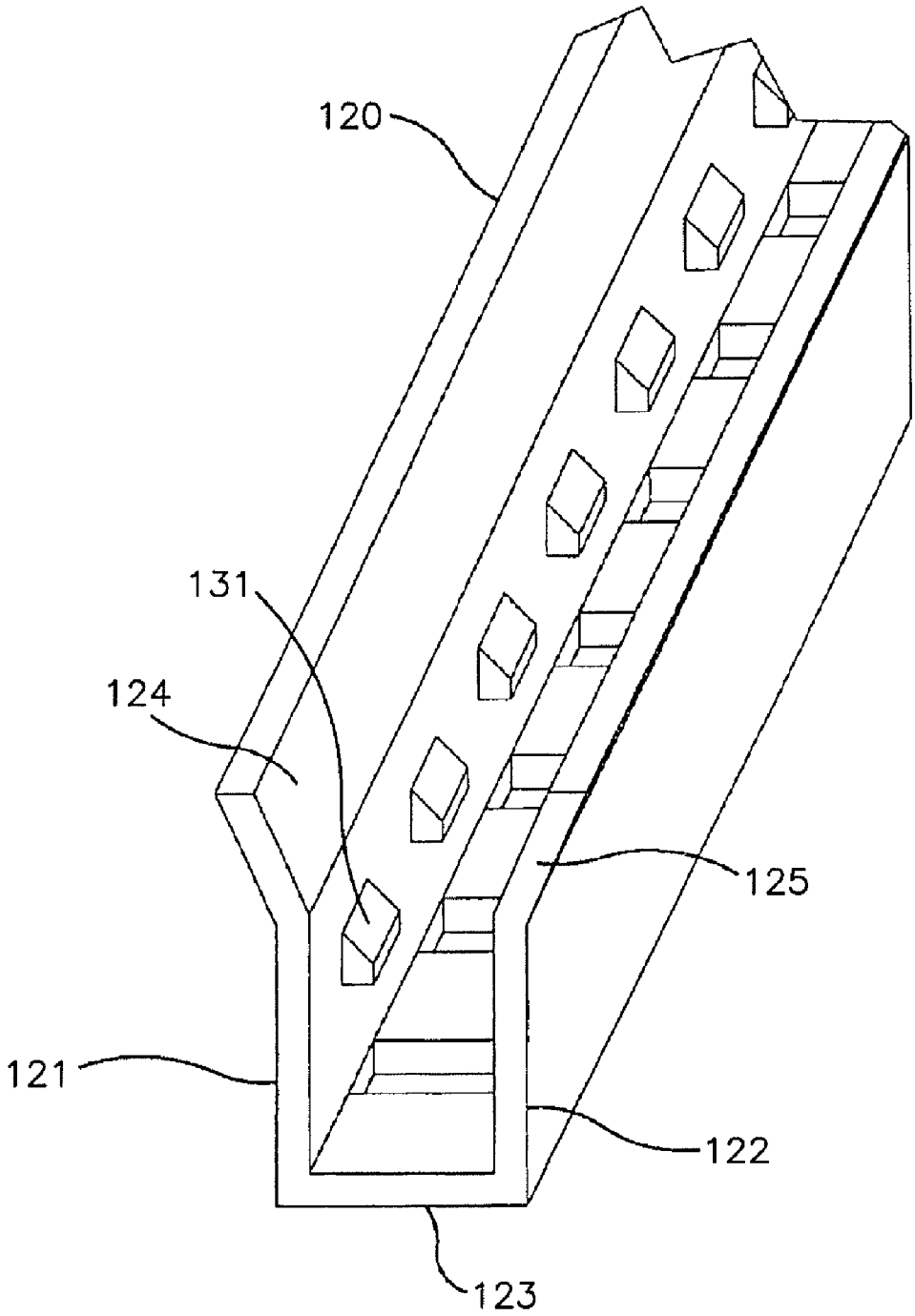
FIG. 12 is a rear, side perspective view of the locking member of FIG. 11.
Figure 13:
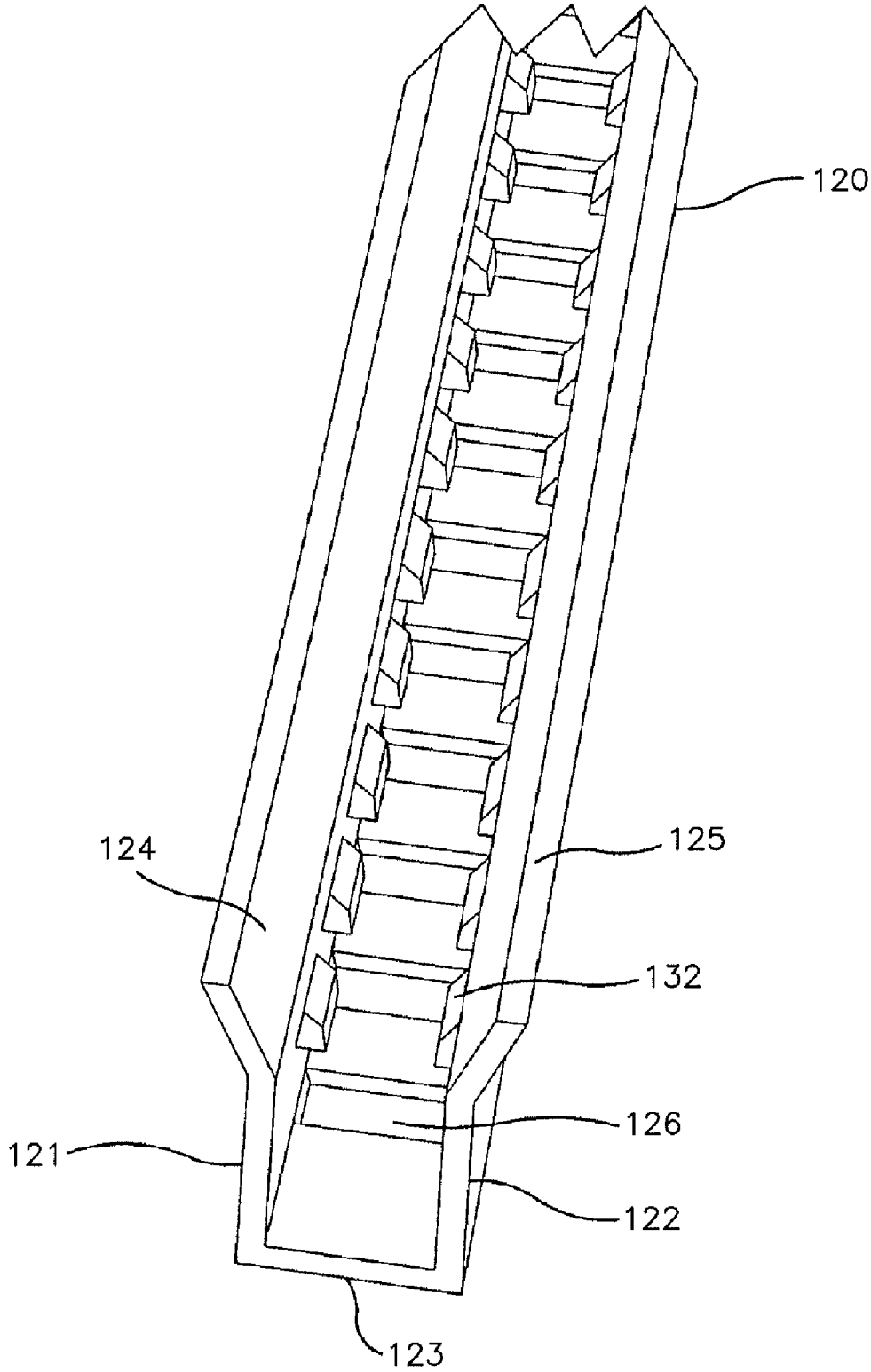
FIG. 13 is a top, side perspective view of the locking member of FIG. 11.

FIG. 10 is a partial cross-sectional view of this illustrated embodiment showing the locking tab of the locking member in one side of apertures of the privacy inserts.

Figure 14:
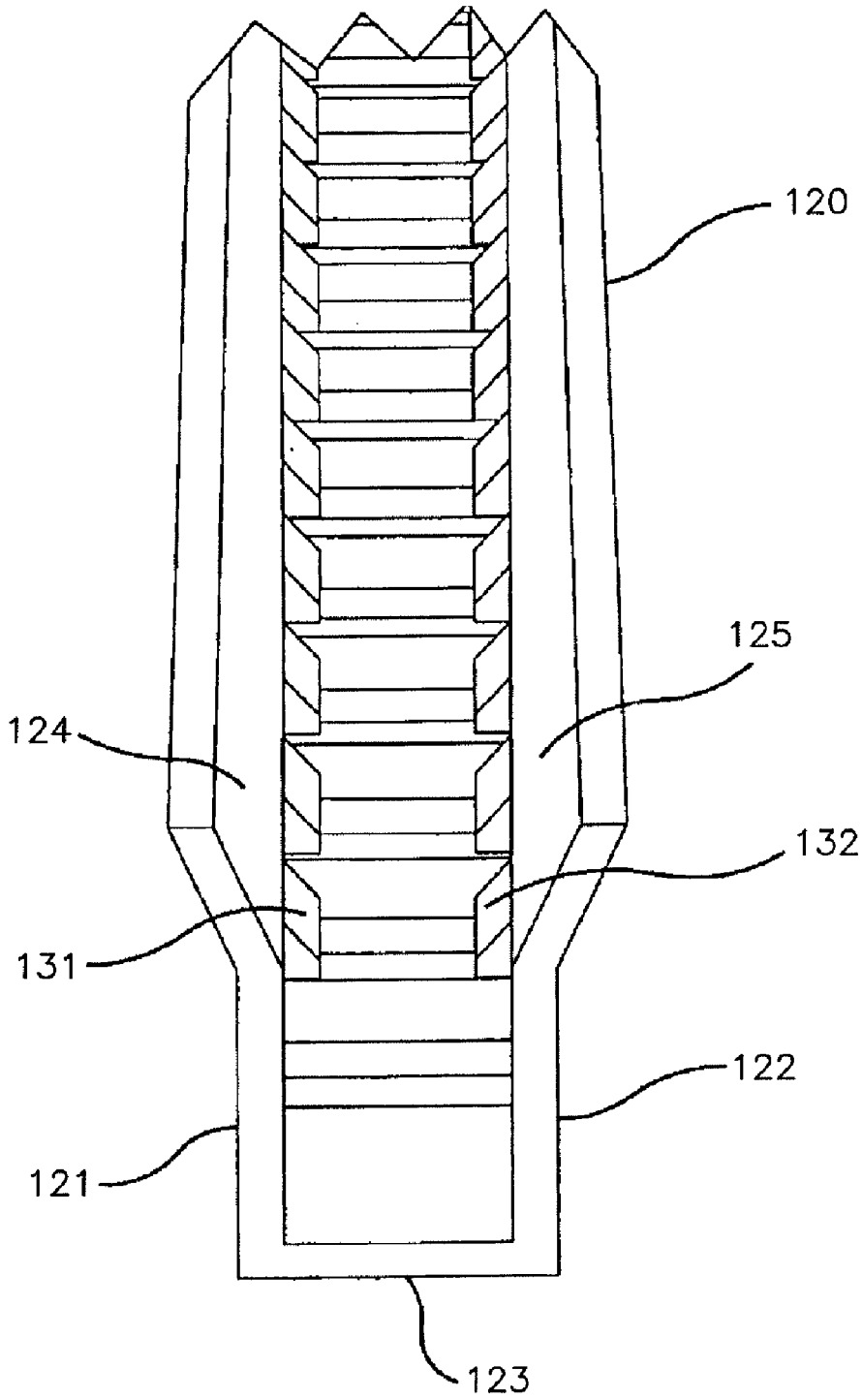
FIG. 14 is a side perspective view of the locking member of FIG. 11.
Figure 16:
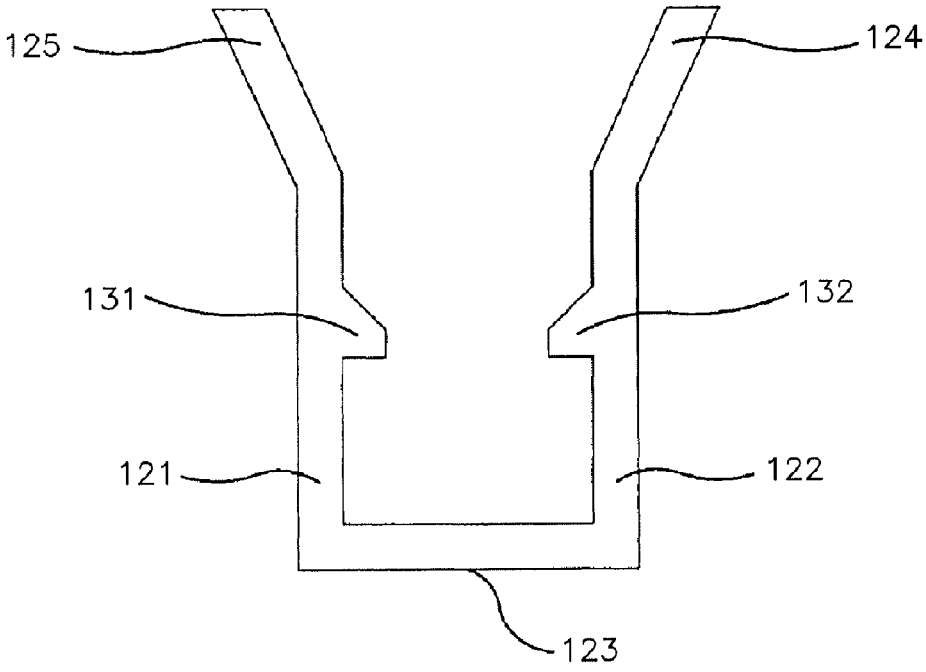
FIG. 16 is a side view of the locking member of FIG. 11.
Figure 17:
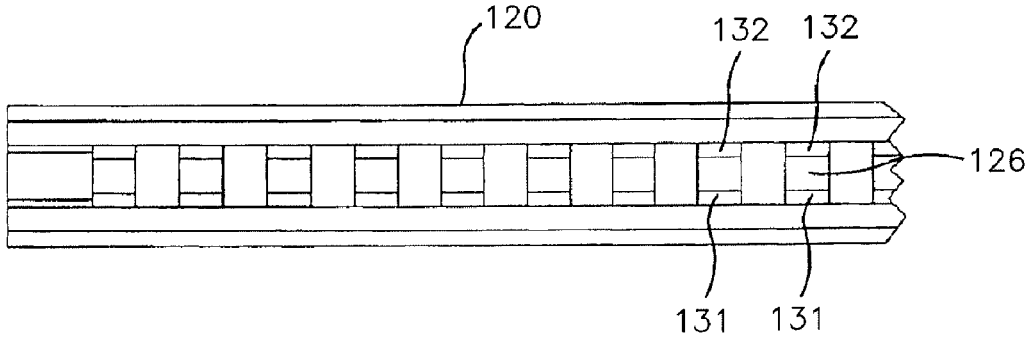
FIG. 17 is a top view of the locking member of FIG. 11.
Figure 18:
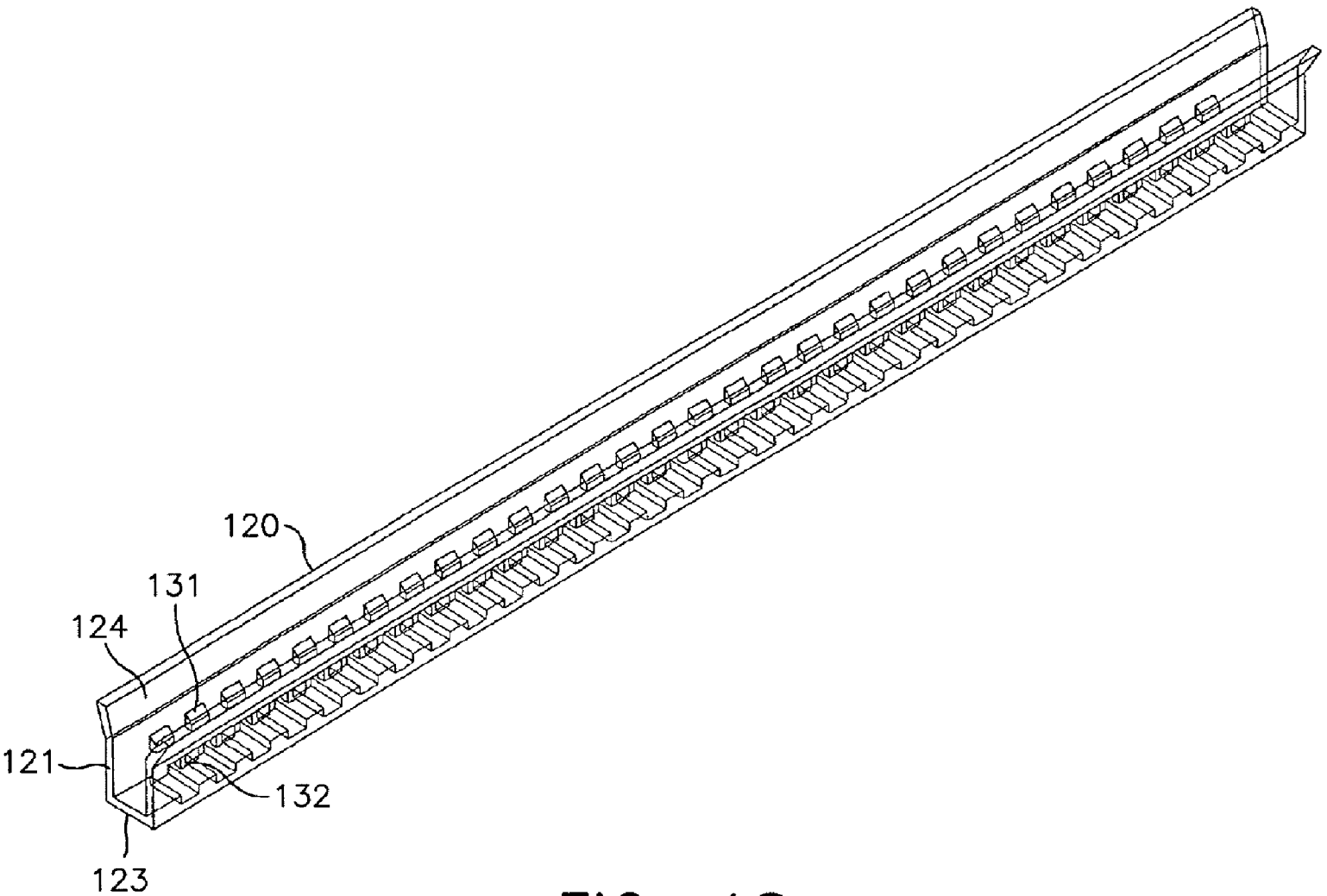
FIG. 18 is a perspective view of the bottom member of FIG. 11 with a portion of the front shown in phantom.

In this illustrated embodiment, as can be seen in FIGS. 14 and 17, locking tabs 131 align with locking tabs 132 so that locking tabs 131 on front wall 121 face corresponding locking tabs 132 on the rear wall 122. Profile views of locking tabs 131 and 132 are shown in FIGS. 6 and 16. As viewed in FIGS. 6 and 16, the top surfaces of locking tabs 131, 132 are angled downwardly to guide and facilitate insertion of a privacy insert 110 into the interior U-shaped channel of locking member 120. From the present description, it will be appreciated that upwardly facing horizontal ledges in the locking member are preferably avoided as they could impede assembly. The bottom edges of the illustrated locking tabs 131, 132 are substantially horizontal thereby facilitating engagement of the bottom edge of the apertures of the privacy insert 110 with the bottom edges of locking tabs 131 and 132. As illustrated in the first embodiment, these edges can also be angled downwardly to impede removal of an insert from the locking member. The spacing between opposing locking tabs on the front and rear walls is less than the depth of a privacy inserts in the region of the aperture. The portion of the privacy insert proximate the aperture, the walls of the locking member, and/or the locking tabs are also somewhat resilient to permit the larger privacy inserts to be inserted between the locking tabs. In this configuration, when a privacy insert 10 is inserted into the bottom locking member 20, the front and rear locking tabs extend at least partially into the front and rear apertures. In this embodiment, apertures receive the same number of front and rear locking tabs.

Figure 15:
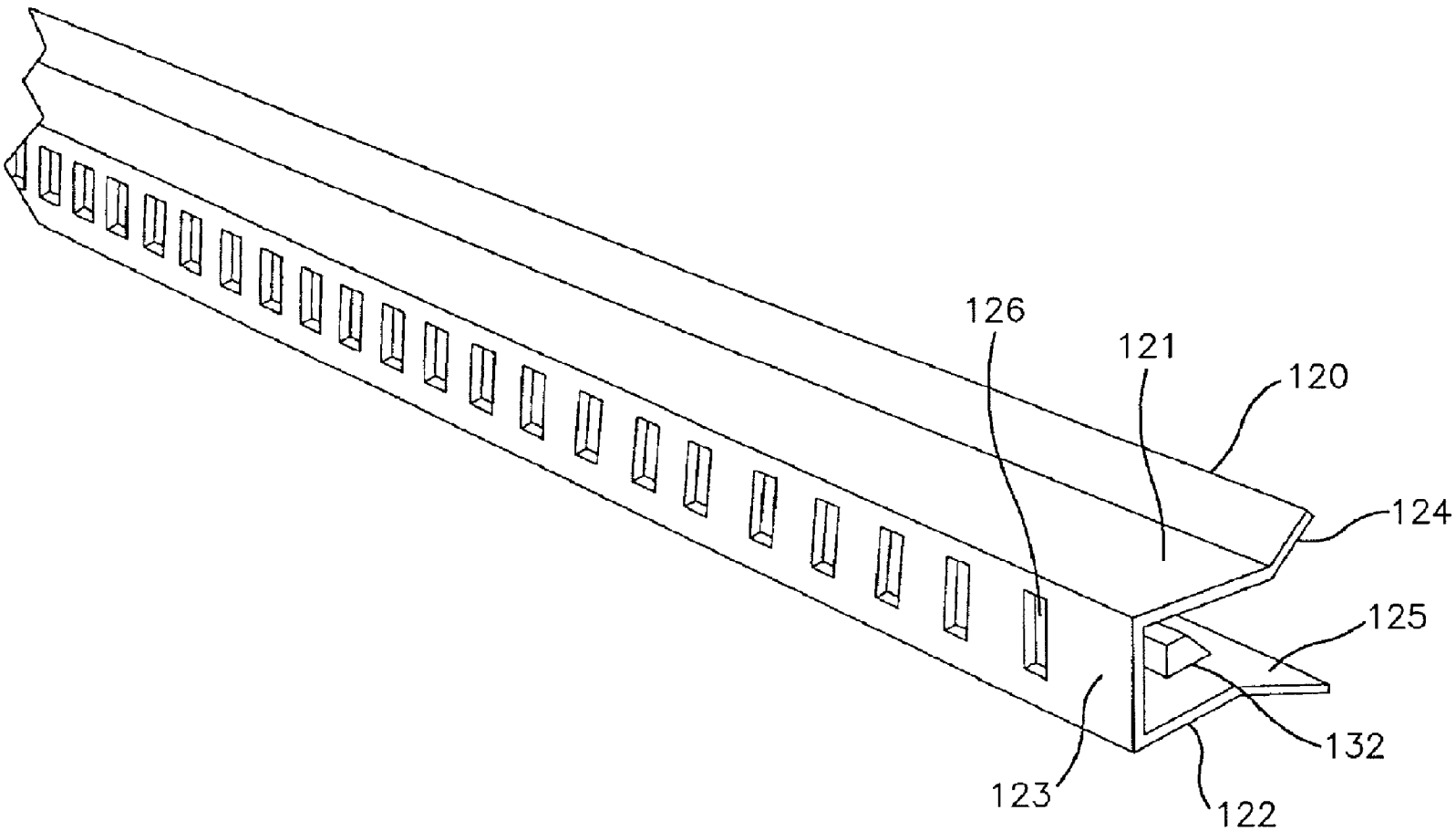
FIG. 15 is a bottom, side perspective view of the locking member of FIG. 11.

As shown in FIG. 15, the bottom wall 123 of the locking member 120 of this embodiment is substantially flat and optionally comprises a plurality of evenly spaced apertures 126. These apertures 126 facilitate drainage when locking member is installed, and can facilitate manufacturing by minimizing shrinkage. The locking member 120 is typically extruded of plastic material. Without apertures 126, the bottom wall 123 would have a tendency to arch during cooling due to an excess of plastic material. The privacy inserts and the locking members can be formed of known polymeric materials, such as polyethylene or polypropylene.

Figure 19:
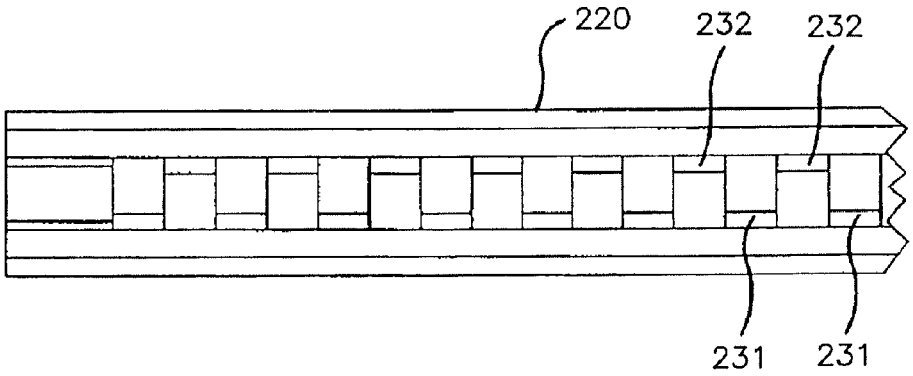
FIG. 19 is a partial top view of a third embodiment of the locking member of the present invention.

A third preferred embodiment of the locking member illustrated in FIG. 19 comprises locking tabs 231 extending from the interior surface of front wall 221 and locking tabs 232 extending from the interior surface of rear wall 222 that are somewhat laterally offset. As illustrated in FIG. 19, which is a top view of this embodiment, locking tabs 231 are not positioned opposite locking tabs 232. In this configuration, when a privacy insert is inserted into locking member 220, depending on where along the bottom locking member 220 the privacy insert is inserted, one of the apertures of the privacy insert will receive at least two locking tabs and the other aperture of the same privacy insert will receive at least one locking tab. For example, when the privacy insert is inserted, the front aperture will receive two locking tabs 231 and the rear aperture receives one locking tab 232. With this arrangement, the front and rear apertures do not receive the same number of locking tabs.

Figure 20:
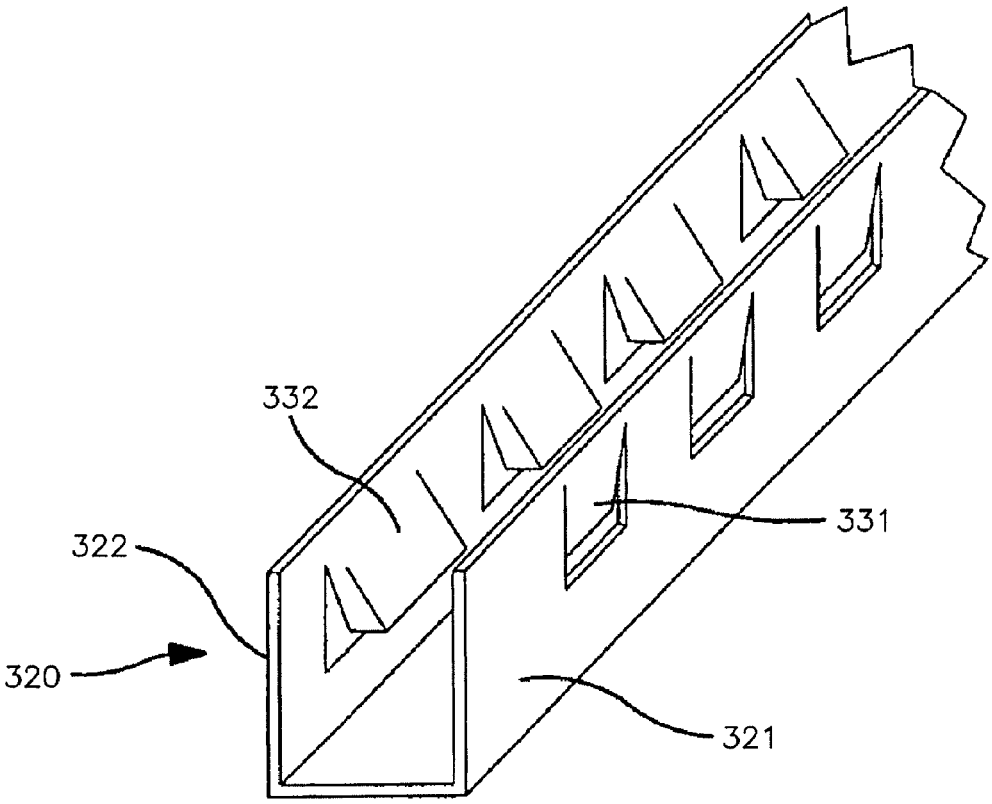
FIG. 20 is a partial perspective view of a fourth embodiment of the locking member of the present invention.

A fourth embodiment of the present invention illustrated in FIG. 20 comprises a privacy insert as disclosed above in the previous embodiments and a locking member 320 which has punched out locking tabs. A plurality of locking tabs 331 on the front side 321 and a plurality of locking tabs 332 on the rear side 322 are formed by partially cutting out, e.g. with a punch, portions of the front and rear sides 321, 322 of the bottom locking member 320. This leaves apertures in the supports 321 and 322 and results in locking tabs which are movably connected to the front and rear walls of the locking tab with the portions of the locking tab not connected to the front and rear sides extending inwardly to engage an aperture of an insert. The locking tabs 331, 332 are angled downwardly so that a privacy insert can be easily inserted into the locking member 320. Once inserted, at least one of the locking tabs 331 and 332 each engage an aperture of a privacy insert. In this illustrated embodiment, the front tabs 331 and the rear tabs 332 are slightly offset. The arrangement of the tabs in this embodiment, however, can be altered. For example, the front and rear tabs can be arranged opposite each other.

According to other embodiments, the inserts area non-tubular, e.g. C-shaped or solid while still comprising apertures or slots in their front and rear surfaces. Also, in a less preferred embodiment, the locking tabs can be provided on only one of the front or rear walls.

The invention claimed is:

1. A privacy system for a fence comprising a plurality of privacy inserts and a locking member, said plurality of privacy inserts being insertable into said locking member, said privacy inserts each including an elongated body having a front, face, a rear lace and at least one side;

said elongated body including a first end and a second end;

said front face having a front notch and said rear face having a rear notch, both of said notches being equally spaced from said first end so that the notches are in alignment with each other, said notches being located at a distance from the first end so as to receive locking tabs of said locking member when the elongated body is inserted into said locking member;

said notches having a width (W) less than a width of said elongated body and a height (H);

said locking member including a front support, a rear support spaced from said front support, and a connector portion connecting said front support and said rear support, said supports and said connector portion defining it channel within which said elongated body is insertable;

each of said front support and said rear support including an inner surface and an outer surface wherein the respective inner surfaces generally face each other;

said front support including a first plurality of spaced locking tabs, said first plurality of spaced locking tabs being integrally formed with said front support and extending inwardly; and said rear support including a second plurality of spaced locking tabs, said second plurality of spaced locking tabs being integrally formed with said rear support and extending inwardly, the first plurality of locking tabs on said front support being positioned laterally offset from said second plurality of locking tabs on said rear support;

each locking tab of said first and second plurality of spaced locking tabs having a width extending from a first side to a second side of a locking tab and a distance from said first side of one locking tab to said second side of an adjacent locking tab being less than said width (W) of said notches, and said first and second plurality of spaced locking tabs being dimensioned and spaced so that both the front notch and the rear notch of said elongated, body inserted into said locking member receives at least one of said first and second plurality of spaced locking tabs, respectively, and at least one of said front and rear notches receives a plurality of either said first plurality of spaced locking tabs or said second plurality of spaced locking tabs.

2. The privacy system for a fence according to claim 1, wherein the width of an said elongated body is less than a total distance spanned by three contiguous locking tabs and three spaces between said contiguous locking tabs.

3. The privacy system for a fence according to claim 1, wherein said elongated body is generally tubular.

4. The privacy system for a fence according to claim 3, wherein said elongated body includes a generally oblong cross section defined by said front face, said rear face, a right side and a left side.

5. The privacy system for a fence according to claim 1, wherein said connector portion includes a plurality of openings.

6. The privacy system for a fence according to claim 1, wherein said locking tabs include a first surface generally facing said connector portion and a second surface generally facing away from said connector portion.

7. The privacy system for a fence according to claim 6, wherein said second surface extends at an angle inwardly and toward said connector portion to facilitate insertion of a privacy insert into said locking member.

8. The privacy system for a fence according to claim 7, wherein said first surface is substantially perpendicular to a closest one of said front support and said rear support.

9. The privacy system for a fence according to claim 7, wherein said first surface extends at an angle inwardly and toward said connector portion to impede removal of a privacy insert from said locking member.

10. The privacy system for a fence according to claim 1, wherein said locking tabs are angled toward said connector portion.

11. The privacy system for a fence according to claim 1, wherein said front and rear supports include holes adjacent to said locking tabs.

12. The privacy system for a fence according to claim 1, wherein portions of said front and rear supports spaced from said connector portion are flared outwardly to facilitate insertion of a privacy insert into said locking member.

* * * * *